US008127473B2

(12) United States Patent
Zandee et al.

(10) Patent No.: US 8,127,473 B2
(45) Date of Patent: Mar. 6, 2012

(54) SUCTION TUBE DEVICE PROVIDED WITH DRIVE SYSTEMS AND METHOD OF REPAIRING SAME

(75) Inventors: Adriaan Hugo Zandee, The Hague (NL); Peter Alexander Bronsveld, Maassluis (NL); Simon Jan Vos, Klaaswaal (NL); Oscar Wilhelmus Johannes Anema, Delft (NL); Oscar Wilhelmus Johannes Ten Heggeler, Oud-Beijerland (NL)

(73) Assignee: IHC Holland IE B.V., Sliedrecht (NL)

( * ) Notice: Subject to any disclaimer, the term of this patent is extended or adjusted under 35 U.S.C. 154(b) by 237 days.

(21) Appl. No.: 12/415,319

(22) Filed: Mar. 31, 2009

(65) Prior Publication Data

US 2009/0241383 A1 Oct. 1, 2009

(30) Foreign Application Priority Data

Apr. 1, 2008 (EP) ..... 08153908

(51) Int. Cl.
*E02F 3/88* (2006.01)

(52) U.S. Cl. ..... 37/317; 37/324; 37/326; 37/331

(58) Field of Classification Search ..... 37/317, 37/324, 326, 329, 331, 334, 908; 56/8; 299/8, 299/9

See application file for complete search history.

(56) References Cited

U.S. PATENT DOCUMENTS

| | | | | |
|---|---|---|---|---|
| 1,019,610 | A * | 3/1912 | Donnelly | 37/331 |
| 2,346,180 | A * | 4/1944 | Neuman | 37/309 |
| 2,675,927 | A | 4/1954 | Tourneau | |
| 3,253,357 | A * | 5/1966 | Allard | 37/309 |
| 3,322,466 | A * | 5/1967 | Mennekes | 299/60 |
| 3,380,179 | A * | 4/1968 | Schmidt | 37/312 |
| 3,495,409 | A * | 2/1970 | Riedemann | 405/286 |
| 3,605,533 | A * | 9/1971 | Dugle | 82/165 |
| 3,657,950 | A * | 4/1972 | Dugle | 82/104 |
| 3,770,067 | A * | 11/1973 | Ikeda | 175/95 |
| 3,773,121 | A * | 11/1973 | Ikeda | 175/95 |
| 3,777,376 | A * | 12/1973 | Turner et al. | 37/309 |
| 3,808,916 | A * | 5/1974 | Porter et al. | 81/57.19 |
| 4,005,019 | A * | 1/1977 | Parlette | 210/525 |
| 4,022,028 | A * | 5/1977 | Martin | 405/159 |
| 4,295,286 | A * | 10/1981 | Brandwijk et al. | 37/334 |
| 4,305,214 | A * | 12/1981 | Hurst | 37/331 |
| 4,680,879 | A * | 7/1987 | Hill et al. | 37/331 |
| 4,914,841 | A * | 4/1990 | Weinrib | 37/195 |
| 5,551,900 | A * | 9/1996 | Dauffenbach et al. | 440/111 |
| 6,178,670 | B1 * | 1/2001 | Susman et al. | 37/313 |
| 6,908,393 | B1 * | 6/2005 | Falk | 464/10 |
| 7,093,382 | B1 * | 8/2006 | Price | 37/309 |
| 7,607,498 | B2 * | 10/2009 | Roussy | 175/415 |
| 7,743,853 | B2 * | 6/2010 | Rudshaug et al. | 175/162 |
| 2002/0084120 | A1 * | 7/2002 | Beasley | 180/65.3 |

FOREIGN PATENT DOCUMENTS

| | | |
|---|---|---|
| EP | 0778658 A1 | 6/1997 |
| EP | 1882783 A2 | 1/2008 |

* cited by examiner

*Primary Examiner* — Thomas Beach
*Assistant Examiner* — Matthew Buck
(74) *Attorney, Agent, or Firm* — The Webb Law Firm

(57) ABSTRACT

A suction tube device having a frame, a tube, a centrifugal pump which cooperates with the tube, and a cutter head at one end of the tube. The tube, centrifugal pump, and cutter head are supported by the frame. The centrifugal pump and the cutter head are each provided with a drive system, the drive systems of the centrifugal pump and of the cutter head each having at least one motor. A motor of the drive system of the cutter head and a motor of the drive system of the centrifugal pump are interchangeable with respect to each other.

14 Claims, 2 Drawing Sheets

SUCTION TUBE DEVICE PROVIDED WITH DRIVE SYSTEMS AND METHOD OF REPAIRING SAME

The invention is related to a suction tube device, comprising a frame, a tube, a rotating cutting device at one end of the tube and a centrifugal pump which cooperates with the tube, said tube, centrifugal pump and rotating cutting device being supported by the frame, said centrifugal pump and said rotating cutting device each being provided with a drive system, the drive systems of the centrifugal pump and of the rotating cutting device each comprising at least one motor.

Such suction tube devices are widely known. They are applied in connection with suction dredgers which are used to cut dredging material from the bottom of a body of water, and to transport said dredging material through a floating line to the disposal site or into the hopper of a barge. These works are usually carried out at remote locations, and will be continued during prolonged time periods. In this connection, it is of course of utmost importance to ensure that said works are not impeded by malfunctioning of the several mechanical and electric components thereof.

However it appears that interruptions of the dredging process occur which are to be attributed to the drive system. In particular it has turned out that motors are a source of failures, especially when motors are applied in drive systems below the waterline where they are more vulnerable for damage due to leakage. These failures take the form of motors which need to be repaired, or which have to be replaced fully because they are damaged beyond repair. However, repairing these motors require special tools, specially trained personnel and special repair facilities. The repair facilities onboard the dredging means are often limited and not suitable for these repairs, which means that the motors in question have to be shipped for repair and substitute motors have to be used, which of course results in downtime of the dredger. The associated costs are appreciable, and it is therefore an object of the invention to provide a dredging tube device which mitigates these problems.

Said object is achieved in that a motor of the drive system of the rotating cutting device and a motor of the drive system of the centrifugal pump are interchangeable with respect to each other and in that one of said drive systems comprises two motors.

In case any of the motors fails, the dredging operations may still be continued. For instance, in case one of the motors of the drive system having two motors fails, said drive system may still be operated, be it at reduced power. Conversely, in case the single motor of the other drive system fails, one of the motors of the drive system having two motors may be taken and installed in lieu of said single defect motor. Here as well the operations may then continue, again of course at a reduced power. Consequently, only a relatively short downtime period is required which is considerably shorter than downtime periods for repair. It is sufficient to simply replace the defect motor, after which step the dredging process can be resumed. Such replacement activities are of a relatively simple character, and can be carried out by the staff on location.

The interchange-ability of the motors can be obtained in different ways. In any case, it is of importance that the fixation means of the motor in question are suitable for operating with the drive system in question. Flange connection and flange sealing shall have to be tuned. Moreover, the power characteristic of the motor are of importance as well as cooling characteristics of the motor. A proper interchange-ability is obtained in case a motor of the one drive system is identical to a motor of the other drive system. In this connection a way of working towards interchange-ability of the motors is to adjust a transmission of any of the drive systems to accommodate for different operating speeds of the rotating cutting device and the centrifugal pomp.

The drive system of the centrifugal pump preferably comprises two motors, said motors being interchangeable with respect to each other. Here as well, identical motors are preferred. In case the motor of the rotating cutting device drive system is defect, it is possible to dismount one of the two motors of the centrifugal pump drive system and to mount said dismounted motor onto the rotating cutting device drive system. It is true that the capacity of the drive system from which the still functioning motor has been taken, is reduced, however the ensuing reduction of the dredging capacity is far more acceptable than a complete shut down of the dredging operations. Additionally, the advantage is obtained that the centrifugal pump can continue to be operated in case one of the motors of the centrifugal pump drive system fails.

Of course, it is also possible to apply two motors to the drive system of the rotating cutting device and a single motor to the dive system of the pump. The same redundancy of the suction tube device as described before is now obtained as well.

The drive system having two motors, e.g. of the centrifugal pump, may comprise a gear box having two input shafts and a single output shaft, the motors each being coupled to a respective input shaft. Depending on the embodiment selected, either the centrifugal pump or the rotating cutting device is then coupled to the output shaft. Furthermore, the centrifugal pump drive system may comprise at least one torque limiting coupling, preferably a flexible coupling, for protecting the motor(s) of the centrifugal pump in case of emergency.

The invention is also related to a method of repairing a suction tube device, the drive system comprising a single motor having a defect, comprising the steps of:

dismounting the defect motor from said drive system, dismounting one of the functioning motors from the drive system comprising two motors, mounting said dismounted functioning motor to the drive system having a single motor.

Moreover, the method according to the invention may comprise the step of:

sealing the location of the dismounted motor.

The invention does not relate to an embodiment wherein output shafts of the motors are connected in series or also called "tandem configuration".

The motors may be of any type, e.g. electric motors or hydraulic motors.

The invention will now be described further with reference to an embodiment of the suction tube device as shown in the drawings.

Figure 1:
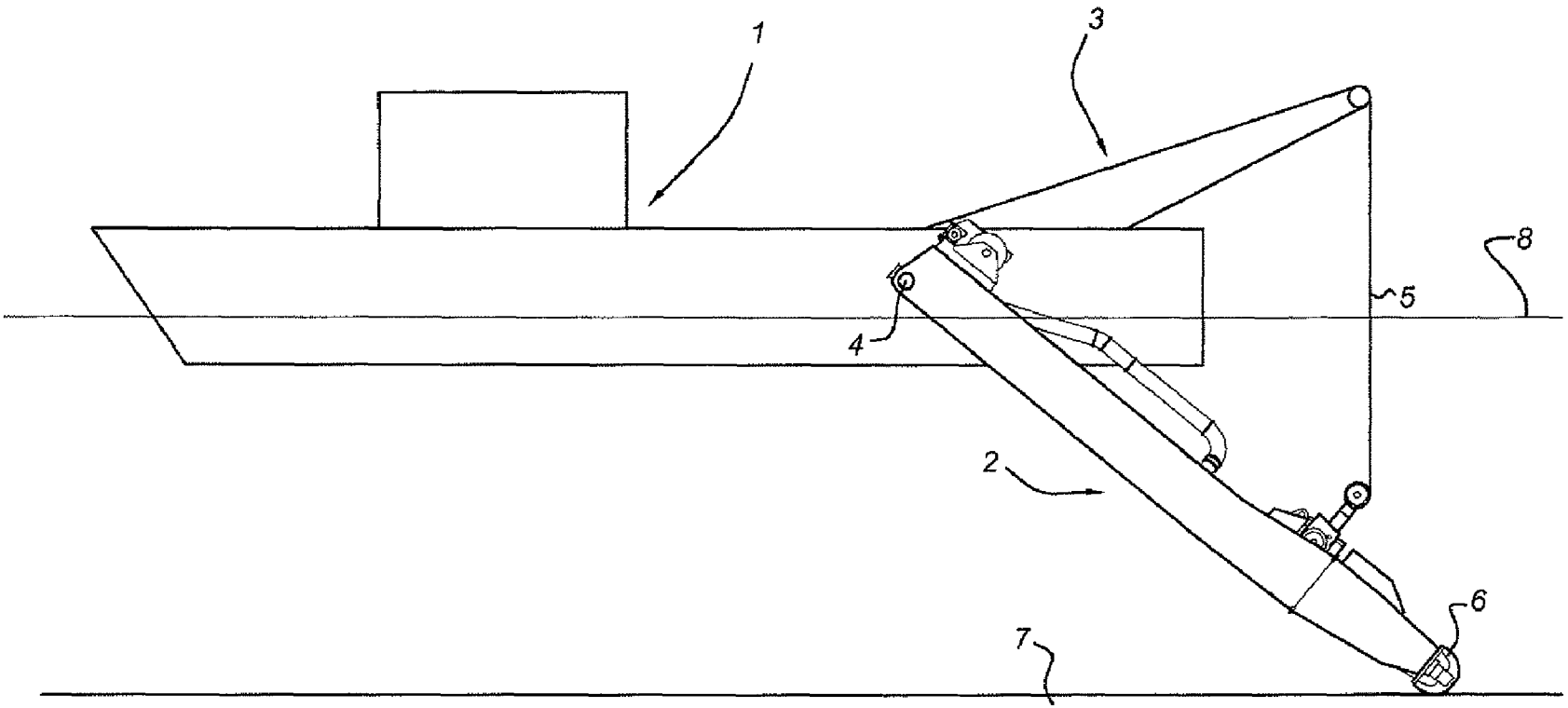
FIG. 1 shows a side view of a cutter dredger.

The cutter dredger shown in FIG. 1 comprises a floating body 1 which carries a suction tube device 2 according to the invention. The suction tube device 2 is mounted to the floating body 1 by means of a hinge 4, and is moveable between the operative position, as shown in FIG. 1, and a generally horizontal rest position by means of the hoist cable 5 of the hoisting device 3. The suction tube device 2 has a cutter head 6 which cuts the bottom material of the bottom 7 of the body of water 8.

Figure 2:
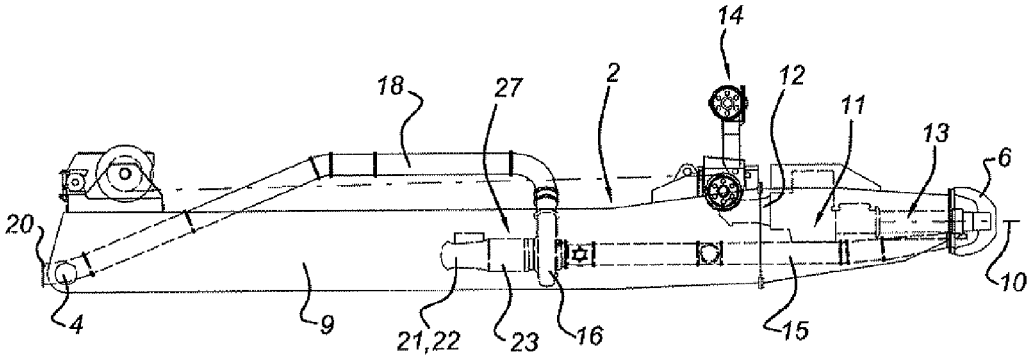
FIG. 2 shows a side view of the suction tube device of the cutter dredger according to FIG. 1.

The suction tube device is shown on a larger scale and in more detail in FIG. 2. It consists of a frame 9 and several other components which are supported on said frame. At one end of the frame 9, the cutter head 6 is rotatably supported with respect to the axis 10. The cutter head is connected to the cutter head drive system 11, which consists i.a. of the electric motor 12 and the shaft 13. In this case one electric motor 12 is shown, though more motors may be used in the cutter head drive system 11. The cutter head drive system 11 may comprise a submergible transmission to accommodate for operational speed differences of the cutter head 6 and the centrifugal pump 16. Furthermore, the hoisting yoke 14 is mounted on the frame 9.

Figure 3:
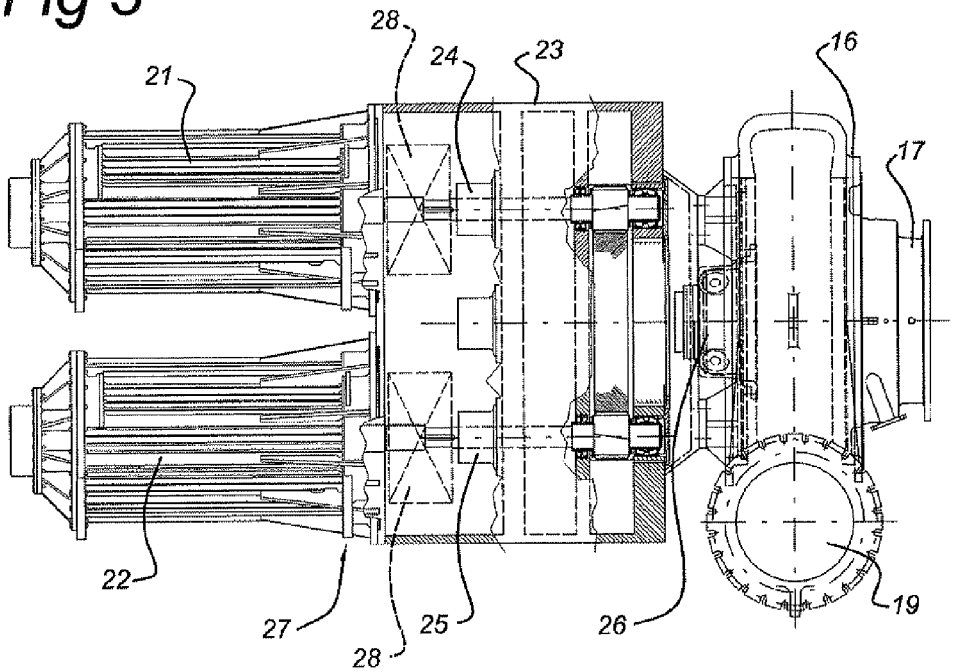
FIG. 3 shows an enlarged view of the centrifugal pump drive system.

A suction tube 15 extends from the cutter head 6 to the inlet 17 of the centrifugal pump 16, see also FIG. 3. A pressure tube 18 extends from the outlet 19 of the centrifugal pump 16 towards the coupling 20, which is to be coupled to a further pressure line on board the floating body and further. The centrifugal pump 16 is driven by means of two electric motors 21, 22 through the gear box 23. Said gear box 23 thus has two input shafts 24, 25, each connected to a respective electric motor 21, 22, and a single output shaft 26 connected to the impeller (not visible) of the centrifugal pump 16. The output shafts of the electric motors 21, 22 are mechanically coupled to the input shafts 24, 25 by means of a schematically represented coupling 28. These couplings 28 of the drive system of the centrifugal pump and a coupling of the drive system of the cutter head are preferably interchangeable as well with respect to each other.

The electric motor 12 of the cutter head drive system 11, and the electric motors 21, 22 of the centrifugal pump drive system 27 are identical. In case the electric motor 12 of the cutter head drive system 11 fails or becomes defect, it is possible to use one of the electric motors 21, 22 of the centrifugal pump drive system 27 to replace that defect cutter head system drive motor 12. The centrifugal pump 16 in that case is able to operate at half its power only. Moreover, the advantage of continued operation, be it at half power, directly after replacing the defect electric motor, is of utmost importance. The position of the electric motor which has been removed from the centrifugal pump drive system 27 is closed by means of a proper sealing plate so as to guarantee its water tightness.

Similarly, in case one of the two electric motors of the centrifugal pump fails or becomes defect, the pump itself is able to operate at reduced capacity. Here as well, the temporary character of reduced power operation, together with the possibility to continue the dredging operation at short notice, offers attractive advantages.

Whereas the invention is described making use of electric drive systems comprising electric motors, the scope of protection is not limited thereto. The claimed invention can also be applied by making use of drive systems comprising hydraulic motors.

The invention claimed is:

1. A suction tube device comprising a frame, a tube, a centrifugal pump which cooperates with the tube, and a cutter head at one end of the tube, said tube, centrifugal pump, and cutter head being supported by the frame, said centrifugal pump being provided with a first drive system and said cutter head being provided with a second drive system which is separate and independent from the first drive system, the drive systems of the centrifugal pump and of the cutter head each comprising at least one electric motor, wherein a motor of the drive system of the cutter head and a motor of the drive system of the centrifugal pump are interchangeable with respect to each other, wherein the drive system of the centrifugal pump comprises two electric motors, said electric motors being interchangeable with respect to each other, wherein an electric motor of the drive system of the cutter head and an electric motor of the drive system of the centrifugal pump, which are interchangeable, are identical, and wherein the electric motors of the drive system of the centrifugal pump are identical.

2. The suction tube device of claim 1, wherein one of the drive systems comprises a transmission.

3. The suction tube device of claim 1, wherein the drive system of the cutter head comprises two motors which are interchangeable with respect to each other.

4. The suction tube device of claim 1, wherein a transmission of the centrifugal pump drive system which comprises two motors comprises a gear box having two input shafts and a single output shaft, the motors each being connected to a respective input shaft.

5. The suction tube device of claim 4, wherein the centrifugal pump is connected to the output shaft.

6. The suction tube device of claim 4, wherein the centrifugal pump drive system comprises at least one torque limiting coupling arranged to protect the electric motors from the centrifugal pump in case of emergency.

7. The suction tube device of claim 4, wherein the cutter head is connected to the output shaft.

8. A method of repairing the suction tube device of claim 1, the drive system of the cutter head comprising a single motor having a defect, comprising the steps of:

dismounting the defect motor from the drive system of the cutter head, dismounting one of the functioning motors from the drive system of the centrifugal pump, and mounting the dismounted function motor of the centrifugal pump drive system to the single motor driven system of the cutter head.

9. The method of claim 8, further comprising the step of:

sealing the drive system of the centrifugal pump location of the dismounted motor.

10. The method of claim 9, further comprising the step of:

watertight sealing of electric contact terminals of cables or hydraulic lines.

11. A suction tube device configured and adapted to be repaired by the method of claim 8.

12. A vessel provided with the suction tube device of claim 1.

13. The suction tube device of claim 3, wherein said two motors are identical.

14. The suction tube device of claim 2, wherein a transmission of the centrifugal pump drive system which comprises two motors comprises a gear box having two input shafts and a single output shaft, the motors each being connected to a respective input shaft.

* * * * *